United States Patent [19]

Bockelmann et al.

[11] 4,058,978

[45] Nov. 22, 1977

[54] REGULATING DEVICE FOR METERING A SUPPLEMENTARY AIR QUANTITY TO IMPROVE COMBUSTION IN COMBUSTION ENGINES

[76] Inventors: Wilfried Bockelmann, An der Kapelle 1, 4046 Buttgen 3; Martin W. Veigel, Stingesbachstrasse 28, 4040 Neuss; Dietrich Grossmann, Einsteinstrasse 25, 4040 Neuss; Hans Grözinger, Corneliusweg 3, 4040 Neuss; Dieter Schwander, Alter Kirchweg 23, 4030 Ratingen, all of Germany

[21] Appl. No.: 576,422

[22] Filed: May 12, 1975

[30] Foreign Application Priority Data

Mar. 31, 1974 Germany ..... 2426594

[51] Int. Cl.[2] ..... F02B 75/10

[52] U.S. Cl. ..... 60/277; 60/285; 123/119 EC; 123/127; 123/198 D; 261/121 B; 261/DIG. 74

[58] Field of Search ..... 60/276, 277, 285; 123/119 R, 119 EC, 198 D, 198 DB, 127; 261/121 B, DIG. 19, DIG. 67, DIG. 74

[56] References Cited

U.S. PATENT DOCUMENTS

| | | | |
|---|---|---|---|
| 3,021,827 | 2/1962 | Brunner | 123/127 |
| 3,590,792 | 7/1971 | Masaki | 261/DIG. 19 |
| 3,648,674 | 3/1972 | Proctor | 123/127 |
| 3,730,157 | 5/1973 | Gerhold | 60/276 |
| 3,789,812 | 2/1974 | Berry | 123/119 R |
| 3,818,701 | 6/1974 | Foster | 123/198 DB |
| 3,861,366 | 1/1975 | Masaki | 123/119 R |
| 3,906,910 | 9/1975 | Szlaga | 123/119 R |
| 3,916,622 | 11/1975 | Gospodar | 60/277 |
| 3,931,710 | 1/1976 | Hartel | 60/276 |

*Primary Examiner*—Douglas Hart
*Attorney, Agent, or Firm*—Haseltine, Lake & Waters

[57] ABSTRACT

The present invention relates to a regulating arrangement for metering a supplementary quantity of air for improving the combustion in internal combustion engines or afterburning of exhaust gases. The amount of air entering the regulating arrangement is metered as a function of the engine speed by means of an air pump driven by the engine. Part of the air entering the regulating arrangement is removed and returned depending on predetermined parameters. An auxiliary device responds to an emergency signal for the immediate shut-off of the fuel or fuel-air mixture used in the combustion. The emergency signal is transmitted by means monitoring the fuel-air ratio within substantially narrow tolerance limits of a predetermined threshold value.

3 Claims, 6 Drawing Figures

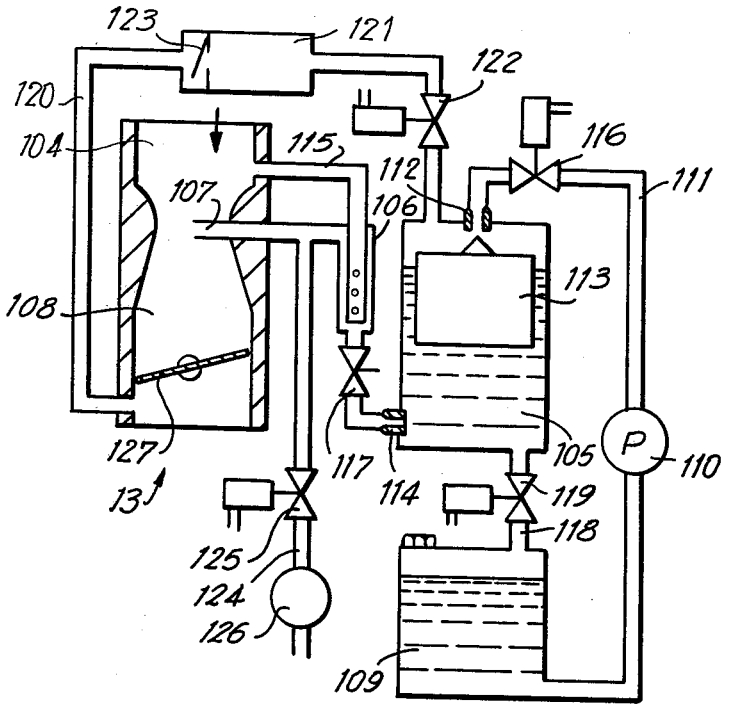
FIG. 2
FIG. 4
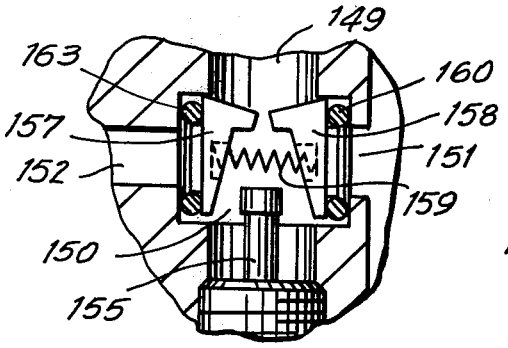
FIG. 5
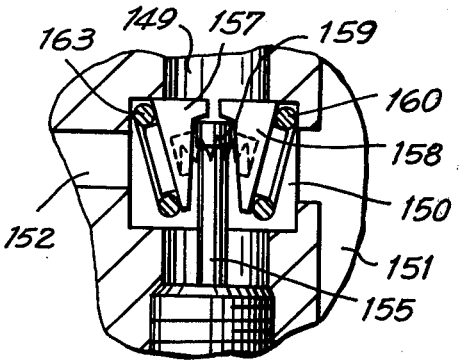
FIG. 6
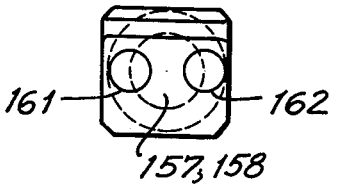

REGULATING DEVICE FOR METERING A SUPPLEMENTARY AIR QUANTITY TO IMPROVE COMBUSTION IN COMBUSTION ENGINES

BACKGROUND OF THE INVENTION

It has been found necessary to transform the harmful materials contained in the exhaust gas of combustion engines, such as carbon monoxide (CO), hydrocarbons ($C_xH_y$) and nitrogen oxides ($NO_x$) by suitable measures into harmless chemical compounds. For this purpose, thermically and catalytically acting reactors or afterburners are being used.

When a combustion engine is operated at varying power, the composition of the exhaust gases varies continuously. This disturbs the afterburning, because either too much or too little oxygen is available for afterburning. It is already known in the art how to avoid this disadvantage by operating the combustion engine with a deficiency of air ($\lambda < 1$) and to deliver the combustion air necessary for afterburning through a motor-operated air pump. Such a device is shown and described in the German Disclosure Document No. 2,035,591.

According to the German Disclosure Documents Nos. 2,012,118 and 2,120,950, the metering of the supplementary air is accomplished by switching devices to which several command variables can be provided as input. According to the German Disclosure Document No. 2,064,266, there is known a switching device for exhaust gas return which also may be influenced by several command variables.

However, with the known devices, the switching conditions vary discontinuously and therefore make continuous regulation impossible.

Another disadvantage of the known devices is that the amount of supplementary air is not controlled discretely and with sufficient speed or reaction time. Hence the afterburner cannot operate at an optimum and the harmful materials are not transformed or converted with sufficient effectiveness.

According to U.S. Pat. No. 3,931,710 it has already been proposed that several command variables be applied to the regulating device from the outside. At the same time, the quantity of air entering the regulating device is metered as a function of the engine speed by means of an air pump driven by the engine; the regulating device comprises a device for the removal and return of part of the air entering the regulating device as a function of the command variables.

In the operation of such a regulating device, trouble may occur when too many unburned hydrocarbons, via the exhaust manifold, reach the afterburner and are combusted there in excessive quantities. Especially with catalytic afterburners, the afterburner may be ruined in a very short time.

It is, therefore, an object of the present invention to remedy this disadvantage and to prevent destruction of the afterburner as a result of improper operation.

Another object of the present invention is to provide an arrangement of the foregoing character which is simple in design and construction, and may be economically fabricated.

A further object of the present invention is to provide an arrangement, as described, which has a long operating life and which has part readily accessible for maintenance and service.

SUMMARY OF THE INVENTION

The objects of the present invention are achieved by providing a supplementary device, responding to an emergency signal, for the sudden shutoff of the fuel or fuel-air mixture participating in the combustion and/or afterburning. The emergency signal is set off by a device which monitors adherence to a previously established fuel-air ratio within narrow tolerance limits.

The supplementary device, in accordance with the present invention, may be used at various locations on the combustion engine or its mixture-forming device.

For example, the supplementary device may comprise a valve located at the intake to the fuel chamber of the mixture-forming device belonging to the combustion engine. As soon as the valve closes upon an emergency signal, the fuel delivery is stopped. The efficiency of this measure greatly depends on whether or not a sufficiently small fuel supply remains in the fuel chamber.

As an alternative, the supplementary device may comprise a valve located downstream from the fuel chamber, but upstream of the main jet of the mixture-forming device belonging to the combustion engine. As soon as the valve closes, no more fuel can leave the fuel chamber.

In one variation of the present invention, the supplementary device consists of a valve located in a discharge line leading from the fuel chamber to the fuel storage tank. During normal operation, this valve is closed; as soon as it opens responding to an emergency signal, the fuel chamber discharges into the tank.

With another variation of the present invention, the supplementary device comprises a valve located in a line connecting the upper air-filled part of the fuel chamber with a source of pressure lower than atmospheric pressure. This source of low pressure may be, for example, the suction or intake pipe of the combustion engine or a special vacuum storage corresponding to the vacuum in the intake pipe. As soon as the valve has opened the connecting line, the fuel is kept in the fuel chamber by the vacuum acting upon the fuel.

In another embodiment of the present invention, the supplementary device comprises a valve located in a line connecting the region of the mixture-forming device of the combustion engine. This region is downstream from the main jet, but upstream from the exit point of the fuel-air-emulsion mixture, and connected to a source of high pressure which is at least equal to atmospheric pressure or higher than atmospheric pressure. As soon as the valve opens responding to an emergency signal, further emulsion formation is no longer possible because the necessary vacuum upstream from the exit point of the fuel-air-emulsion mixture is no longer present.

If a combustion engine has more than two mixture-forming devices, e.g., a multiple carburetor or register carburetor, the above-mentioned valve is suitably provided with a device for the fully synchronous connection of the above-mentioned region with a source of high pressure. The supplementary device is constructed so that the valve has facing spring-loaded valve flaps provided with bellcranks and sealing with a soft sealing ring. These valve flaps are actuated by means of an actuating plunger.

This type of construction has the special advantage that the valve flaps in the non-energized position seal tightly and do not have to be adjusted expressly for this purpose.

With register carburetors, the second mixture-forming device may also be actuated pneumatically by a vacuum box.

In this case, the supplementary device comprises a valve comprising a device for the fully synchronous connection of the region of the first mixture-formation device and of the pneumatic actuating device of the mixture throttle valve of a second or higher mixture-forming device to a source of high pressure. The above region is located downstream from the main jet, but upstream from the exit point of the fuel-air-emulsion mixture.

The supplementary device in accordance with the present invention may also comprise a valve located downstream from the mixture-forming device of the combustion engine in the mixture-carrying channel.

The valve may be an integral part of the randomly operable mixture throttle valve of the combustion engine. As soon as the valve closes, neither mixture nor air can be taken in by the combustion engine.

A special advantage is that the combustion engine is braked at the same time.

Another advantage is that with an integrated valve there is a possibility to stop, at will, the emergency shutoff of the mixture intake, with which a motor vehicle in a difficult traffic situation might have priority over the possible destruction of the afterburner.

A particularly quick emergency shutoff is achieved when the supplementary device comprises a valve located upstream or downstream from the afterburner device.

The valves placed in accordance with the present invention are actuated electromagnetically (solenoid valves).

The combustion engine also offers the possibility of an emergency shutoff, since the supplementary device comprises a cutoff coupling which is capable of disengaging the inlet valves and/or outlet valves from their associated valve gear, e.g., by declutching the camshaft.

The emergency signal can be set off by the failure of the ignition voltage of the combustion engine, by the increase of the hydrocarbon content of the exhaust gases, by the disparity between the position of the mixture metering element and the engine speed, by exceeding a temperature limit in the exhaust manifold, or by exceeding a temperature limit in the afterburner.

It is expedient to transmit the emergency signals as electric signals to the supplementary device.

The advantage of the present invention is that in case of operating troubles in the combustion engine and undesirable fuel excess, the exhaust gas detoxification devices are not impaired and an otherwise unidentified permanant damage to these devices and permanent failure of the exhaust gas detoxification device is prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 2 is a schematic view and shows the fuel intake and mixture forming devices of the carburetor used in the arrangement of FIG. 1;

FIG. 4 is a partial sectional view and shows the construction of a reversing valve used in the arrangement of the present invention;

FIG. 5 is a partial sectional view of another embodiment of the reversing valve; and FIG. 6 is a front view of valve flaps used in conjunction with the constructions of FIGS. 4 and 5.

DESCRIPTION OF THE PREFERRED EMBODIMENTS

Figure 1:
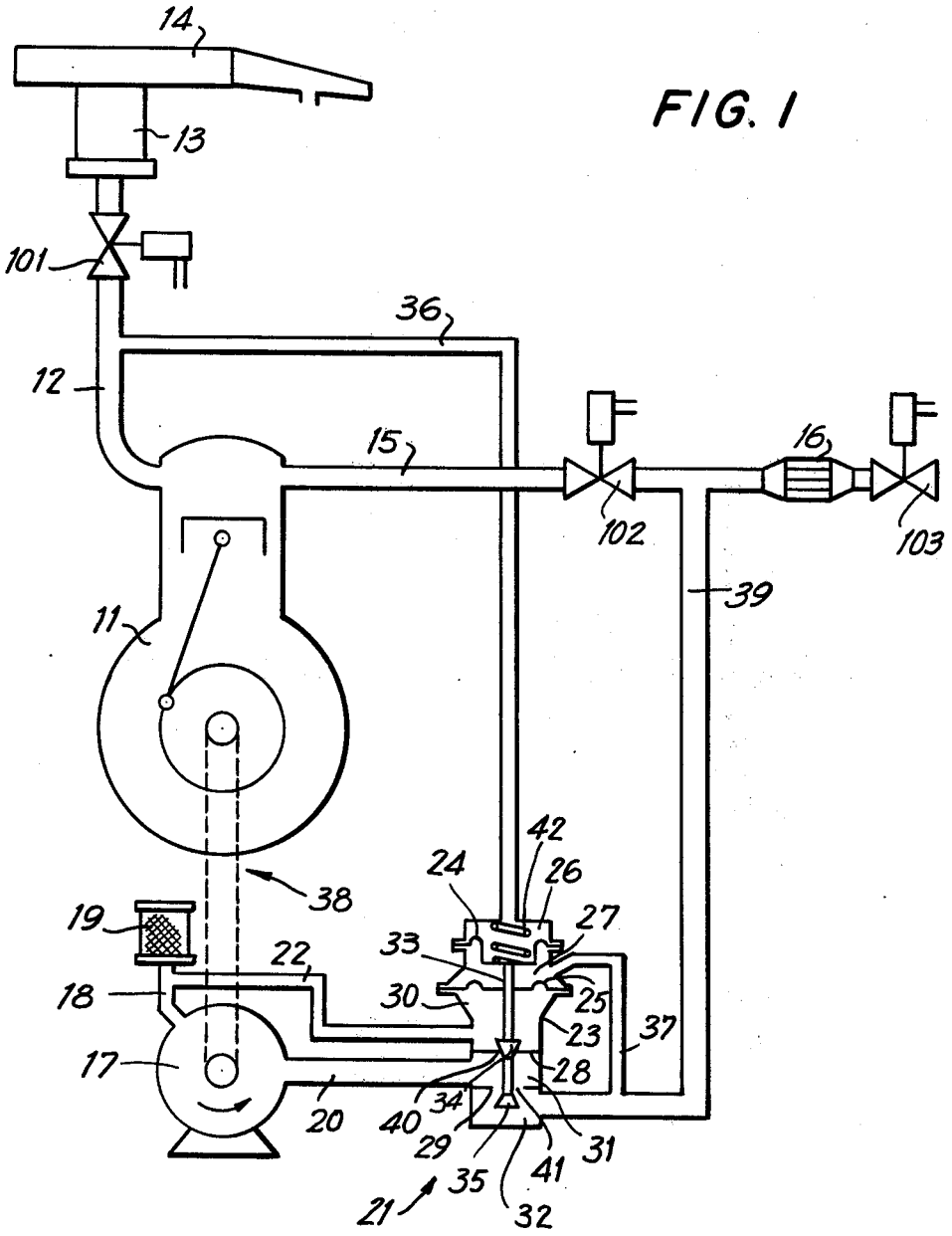
FIG. 1 is a schematic view of the regulating arrangement, in accordance with the present invention.

According to FIG. 1, the combustion engine 11 on the intake side has an intake tube 12 with an end at which carburetor 13 is flange-mounted. Air is supplied through the air filter 14. The fuel intake and mixture forming devices of the carburetor are shown in detail in FIG. 2.

On the exhaust side, the combustion engine 11 has the exhaust manifold 15 which leads to the afterburner 16. An air pump 17 is connected via a suction line 18 to a filter 19 via which additional air is sucked in from the atmosphere. From air pump 17, a line 20 leads to the regulating device 21. An air return line 22 leads from the regulating device 21 back to the suction line 18.

The regulating device 21 has multisectional housing 23 which is subdivided by membranes 24 and 25 into the control pressure areas 26 and 27 and by dividing walls 28 and 29 into the pressure areas 30, 31 and 32. Line 20 opens into pressure area 31 and the air return line opens into the pressure area 30.

Membrane 25 has a larger active area than membrane 24. Both membranes are rigidly connected to a guide bar 33 on which the metering cones 34 and 35 are located on top of one another. The metering cones act together with the metering apertures 40 and 41 located in the dividing walls 28 and 29.

The suction pipe pressure, the exhaust gas counterpressure and the engine rpm are used as command variables which are nonlinearly independent from one another. The exhaust pipe pressure is transmitted to the regulating device 21 via line 36 and the exhaust gas counterpressure is transmitted via line 37.

The engine rpm is transmitted via the gear unit 38 directly to the air pump 17 and indirectly via the rpm-dependent (fuel) delivery quantity by means of line 20 to the regulating device 21. The additional air is blown into the exhaust manifold 15 via line 39.

In the state of rest or nonoperative state, both metering cones are brought to the bottom-most position by means of the compression spring 42 acting on the membrane 24, so that the metering aperture 40 is closed and the metering aperture 41 is opened all the way.

During operation, the air pump 17, depending on engine speed, delivers a variable amount of air. With high exhaust pipe pressure, the compression spring 42 is relaxed, so that the metering cones are pushed downward. The return flow of the additional air from pressure area 31 to pressure area 30 and from there to the air return line 22 is reduced or interrupted while the metering aperture 41 is freed by a variable extent for the passage of the additional air from pressure air into pressure area 32, and from there via line 39 into exhaust manifold 15. The lower the suction pipe pressure, the more the metering cones 34 and 35 are lifted up and the more air is returned, while the delivery of additional air is limited.

Via line 37, the exhaust gas counterpressure prevailing on line 39 is transmitted as command variable to the control pressure area 27. Because of the difference in size between membranes 24 and 25, an increasing exhaust gas counterpressure causes a wider opening and a decreasing exhaust gas counterpressure causes further closing of the metering aperture 41.

Downstream from the mixture forming device of the carburetor 13, the electromagnetically actuated valve 101 is located in the suction pipe. During undisturbed operation, the valve gear is unpowered so that the suction pipe 12 for the mixture passage is opened.

As soon as the valve gear receives an electrical actuating voltage as the result of an emergency signal, it closes valve 101 so that further mixture delivery to the combustion engine 11 is stopped.

As an alternative, instead of valve 101 in the exhaust manifold 15, an electromagnetically operated valve 102 may be located downstream from the afterburner 16. Also, a valve 103 may be located downstream from the afterburner 16 instead.

Furthermore, the last-mentioned valves are opened during undisturbed operation and close upon an emergency signal. Also, two or three valves may be provided simultaneously so that the individual line sections can be cut off at the same time.

FIG. 2 shows a schematic view of the mixture forming devices of carburetor 13.

The combustion air enters in the direction of the arrow into the air funnel 104 which has a restriction in the manner of a Venturi tube. The carburetor further comprises the fuel chamber 105, the mixing tube 106 and the exit branch 107 for the fuel-air-emulsion which is further vaporized in the mixing chamber 108 and mixed with the combustion air.

The fuel delivery from the carburetor 14 proceeds from the fuel storage tank 109 by means of a fuel pump 110 via line 111 and fuel needle valve 112 regulated by float 113 to the fuel chamber. A certain fuel level is kept constant in the fuel chamber 105.

During operation of the combustion engine, a vacuum prevails in the area of the Venturi tube. This vacuum sucks in the fuel via the main jet 114, the mixing tube 106 and the exit branch 107. In the mixing tube 106, emulsion air is sucked in via the correction air channel 115 and emulsified with fuel.

In accordance with the present invention, a valve 116 is located at the intake to the fuel chamber 105 in the fuel line 111. This valve blocks the fuel line upon receipt of an emergency signal.

Downstream from the fuel chamber 105, but upstream from the main jet 114, another valve 117 is located. Both valves are operated electromagnetically. During normal operation they are open.

A valve 119 is located in the discharge line leading from the fuel chamber 105 to the fuel storage tank 109.

From the suction end of the carburetor, a line 120 leads via a vacuum storage 121 and a valve 122 to the upper, air-filled part of the fuel chamber 105. The vacuum storage 121 has a non-return valve 123.

Upstream from the exit of the fuel-air emulsion mixture, a line 124 branches off. This line leads via a valve 125 to a source 126 of high pressure. This may be, e.g., an air pump which also serves other purposes.

Valves 119, 122 and 125 are operated electromagnetically. During normal operation they are closed and open only upon an emergency signal.

If valve 119 opens, the fuel from fuel chamber 105 is discharged into the fuel storage tank 109. The fuel level rapidly drops so that no more fuel can be removed via main jet 114.

If valve 122 is opened, the vacuum prevailing in the vacuum storage 121 acts on the upper air-filled part of the fuel chamber 105. Further fuel removal then is no longer possible via main jet 114.

When opening the valve 125, high air pressure becomes manifest in the exit branch 107 with the result that the fuel is pushed back from the mixing tube 105 into the fuel chamber 105. As a result, fuel or emulsion delivery is stopped.

Another valve 127 has the form of a throttling butterfly valve and is located in the mixture-carrying channel of carburetor 15. This valve can be adjusted at random, and is used for metering the mixture. It may be integrated with the valve 101 shown in FIG. 1 and simultaneously serves as emergency shut-off for the mixture.

Figure 3:
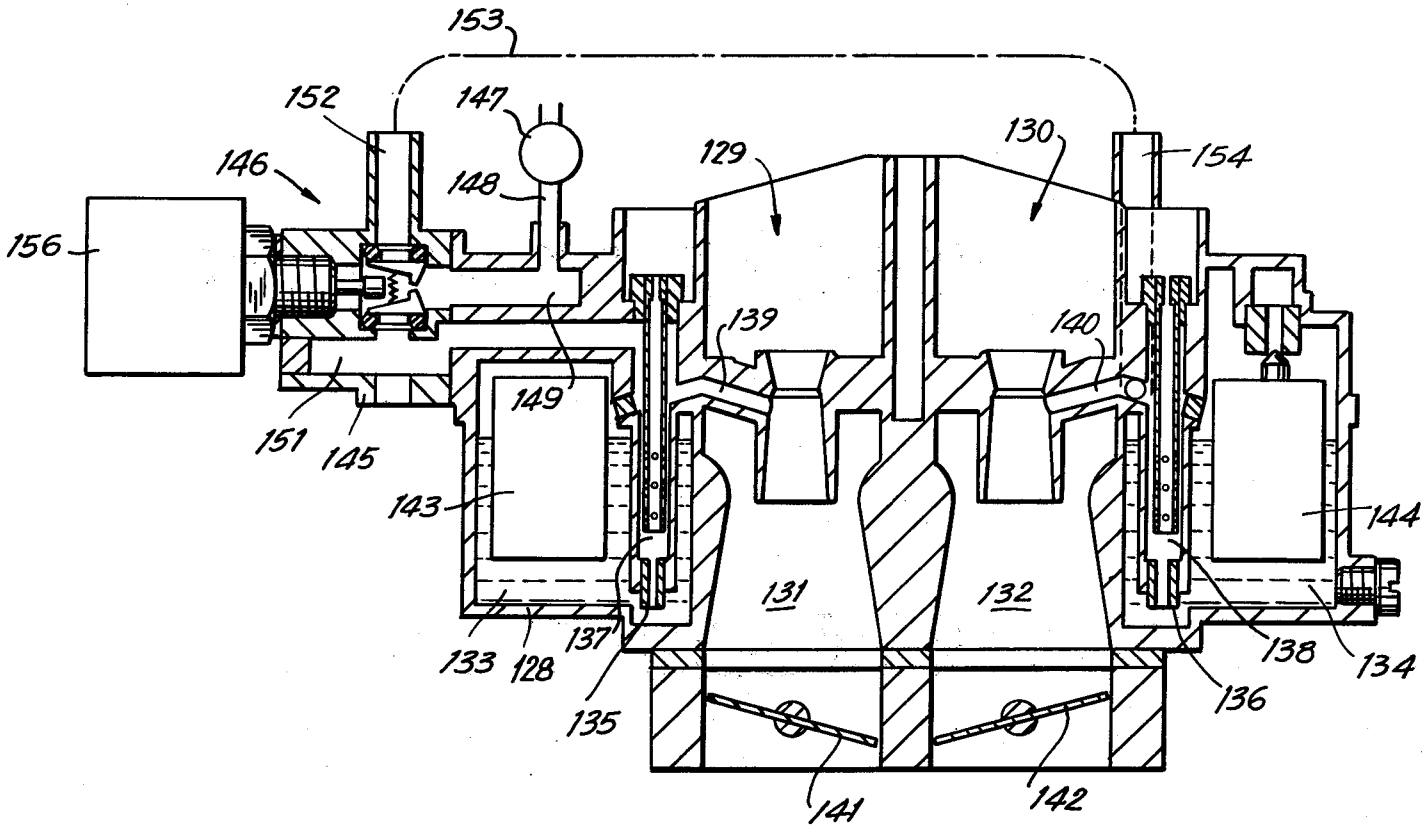
FIG. 3 is a sectional view of a register carburetor in accordance with another embodiment of the present invention.

FIG. 3 shows a section through a register carburetor where a variation of the present invention is being used.

The carburetor housing 128 has two air funnels 129 and 130, two mixing chambers 131 and 132, two fuel chambers 133 and 134, two main jets 135 and 136, two mixing tubes 137 and 138, two exit arms 139 and 140, two mixture throttle valves 141 and 142, and two floats 143 and 144.

During low-load operation, the mixture throttle valve 142 remains closed. However, during full-load operation, both mixture throttle valves are opened.

On the left side of the register carburetor, the housing 145 of a reversing valve 146 is flange-mounted. Details of the reversing valve are shown in FIGS. 4 through 6. From a source 147 of high air-pressure, there is a connection to chamber 150 via line 148 and channel 149 (FIGS. 4 and 5). From one sidewall of chamber 150, there is a connection to exit or exhaust branch 139 via channel 151. From the other sidewall of chamber 150, there is a connection to the other exit or exhaust branch 140 via channel 152, line 153 and channel 154.

In the state of rest, the plunger 155 of the electromagnetically actuated valve gear 156 is pulled back as shown in FIG. 4. The valve flaps 157 and 158 equipped with bellcrank levers are forced apart by compression springs 159 so that their soft gaskets or sealing rings 160 and 163 rest against the sidewalls of chamber 150 and tightly seal the intake openings of channels 151 and 152.

As soon as the valve gear receives an electrical actuating voltage as a result of an emergency signal, the plunger 155 is pushed upward as shown in FIG. 5. The plunger 155 pushes the bellcranks of the valve flaps 157 and 158 upward at the same time. The compression springs 159 are loaded and the valve flaps with their soft sealing rings lift off from the sidewalls of chamber 150 and open the intake apertures of channels 151 and 152 to chamber 150. Now the higher air pressure prevailing in chamber 150 comes into play via channel 151 in exit or exhaust branch 139 and simultaneously via channel 152, line 153 and channel 154 in the other exit branch 140 of the register carburetor. The result is that the fuel present in mixing tubes 137 and 140 is pushed back through the two main jets 135 and 136 into the fuel chambers 133 and 134. This realizes the purpose of the invention —the sudden stoppage of further mixture delivery from the carburetor.

FIG. 6 shows a front view of valve flaps 157 and 158 indicating the location of the drill holes 161 and 162 for the compression springs.

In order to accomplish the purpose of the present invention, it is not necessary to simultaneously provide all supplementary devices of the present invention on one and the same carburetor. It is fully sufficient to select a single or a few supplementary devices depending on the prevailing requirements.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. In an auxiliary arrangement for the protection of an afterburner installation for the exhaust gases of an internal combustion engine having a regulating arrangement for the metering of a secondary air quantity, the improvement comprising: a source of fluid under pressure equal to or greater than atmospheric pressure; a switching installation instantaneously responsive to an emergency signal for switching off the fuel, said emergency signal representing an electrical impulse; means for initiating said electrical impulse upon exceeding a predetermined amount of unburned hydrocarbons; in the exhaust fuel reservoir means; fuel-air mixture forming means; and fuel conducting means between said fuel reservoir means and said fuel-air mixture forming means; control means linked to said source of pressure and actuatable by said emergency signal for releasing said fluid to contact the fuel and move the fuel by applying pressure thereto from said fuel conducting means and into said fuel reservoir means when said emergency signal is initiated; main jet means; said control means comprising a valve in a line connecting said source with a region of said mixture forming means, said region being downstream from said main jet means and being upstream from the exit point of the fuel-air mixture to said source of pressure; said valve comprising further means for synchronous connection of at least two units of said fuel-air mixture forming means to said source of pressure; said valve having facing springloaded valve flaps; bell cranks on said valve flaps; outlet sealing rings; and actuating plunger means for synchronously actuating said valve flaps, said actuating plunger means moving said valve flaps in direction for releasing said sealing rings so that said source of pressure communicates with the fuel at said region.

2. In an auxiliary arrangement for the protection of an afterburner installation for the exhaust gases of an internal combustion engine having a regulating arrangement for the metering of a secondary air quantity, the improvement comprising: a source of fluid under pressure equal to or greater than atmospheric pressure; a switching installation instantaneously responsive to an emergency signal for switching off the fuel, said emergency signal representing an electrical impulse; means for initiating said electrical impulse upon exceeding a predetermined amount of unburned hydrocarbons; in the exhaust fuel reservoir means; fuel-air mixture forming means; and fuel conducting means between said fuel reservoir means and said fuel-air mixture forming means, control means linked to said source of pressure and actuatable by said emergency signal for releasing said fluid to contact the fuel and move the fuel by applying pressure thereto from said fuel conducting means and into said fuel reservoir means when said emergency signal is initiated; main jet means; said control means comprising a valve in a line connecting said source with a region of said mixture forming means, said region being downstream from said main jet means and being upstream from an exit point of a fuel-air mixture to said source of pressure, said valve reversing the flow of fuel when said emergency signal is initiated, the flow of fuel being directed away from said engine when said emergency signal is initiated; said valve comprising facing spring-loaded valve flaps; bell cranks on said valve flaps; sealing rings actuated by said valve flaps for sealing outlet openings of said valve when said emergency signal is absent; and actuating plunger means for synchronously actuating said valve flaps by said bell cranks for removing said sealing rings from said outlet openings when said plunger means receives said emergency signal.

3. The arrangement as defined in claim 2 wherein said valve comprises means for synchronous connection of at least one additional fuel-air mixture forming means to said source of pressure.

* * * * *